US011551601B2

(12) United States Patent
Ahn et al.

(10) Patent No.: US 11,551,601 B2
(45) Date of Patent: Jan. 10, 2023

(54) DISPLAY DEVICE AND DRIVING METHOD THEREOF

(71) Applicant: SAMSUNG DISPLAY CO., LTD., Yongin-si (KR)

(72) Inventors: Ik Hyun Ahn, Yongin-si (KR); Sun Koo Kang, Yongin-si (KR); Cheol Min Kim, Yongin-si (KR); Ji Ye Moon, Yongin-si (KR); Ju Gon Seok, Yongin-si (KR); Hyeon Uk Won, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 43 days.

(21) Appl. No.: 17/166,388

(22) Filed: Feb. 3, 2021

(65) Prior Publication Data

US 2021/0398473 A1 Dec. 23, 2021

(30) Foreign Application Priority Data

Jun. 22, 2020 (KR) ..... 10-2020-0076000

(51) Int. Cl.

| | |
|---|---|
| ***G09G 3/20*** | (2006.01) |
| ***G09G 3/3233*** | (2016.01) |
| ***G09G 3/3275*** | (2016.01) |
| ***G09G 5/10*** | (2006.01) |
| *G09G 3/32* | (2016.01) |

(52) U.S. Cl.

CPC ..... *G09G 3/2007* (2013.01); *G09G 3/3275* (2013.01); *G09G 5/10* (2013.01); *G09G 3/32* (2013.01); *G09G 3/3233* (2013.01); *G09G 2300/0452* (2013.01); *G09G 2310/027* (2013.01); *G09G 2310/08* (2013.01); *G09G 2320/0271* (2013.01); *G09G 2360/16* (2013.01)

(58) Field of Classification Search

CPC .. G09G 3/00; G09G 3/10; G09G 3/20; G09G 3/30; G09G 3/32; G09G 3/34; G09G 3/36; G09G 3/2007; G09G 3/3233; G09G 3/3208; G09G 3/3275; G09G 3/3258; G09G 3/3266; G09G 3/3291; G09G 2300/0452; G09G 2310/027; G09G 2310/08; G09G 2320/0271; G09G 2360/16; G09G 5/02; G09G 5/10; G09G 5/36; G09G 5/38; G09G 5/373; G09G 5/391; G09G 5/393; G02F 1/1362; G02F 1/1368

See application file for complete search history.

(56) References Cited

U.S. PATENT DOCUMENTS

| | | | | |
|---|---|---|---|---|
| 9,336,742 | B2 | 5/2016 | Ahn et al. | |
| 9,396,694 | B2 | 7/2016 | Ahn et al. | |
| 2015/0206486 | A1 * | 7/2015 | Inada | G09G 3/3614 345/96 |

(Continued)

*Primary Examiner* — Chanh D Nguyen
*Assistant Examiner* — Nguyen H Truong
(74) *Attorney, Agent, or Firm* — Cantor Colburn LLP

(57) ABSTRACT

A display device includes: a gray converter which adds compensation grays to input grays to provide output grays; a data driver which provides data voltages corresponding to the output grays; and a display panel which includes pixels which receives the data voltages, where the gray converter includes: a voltage domain converter which converts the input grays into conversion grays; and a compensation gray calculator which calculates the compensation grays based on the conversion grays.

15 Claims, 15 Drawing Sheets

(56) References Cited

U.S. PATENT DOCUMENTS

| | | | | |
|---|---|---|---|---|
| 2016/0155387 | A1* | 6/2016 | Kim | G09G 3/3291 345/76 |
| 2018/0182328 | A1* | 6/2018 | Hwang | G09G 3/3614 |
| 2018/0330665 | A1* | 11/2018 | Fujii | H01L 27/3276 |

* cited by examiner

LUT

| | | VVpre | | | | |
|---|---|---|---|---|---|---|
| | | 0 | 8 | 40 | 168 | 255 |
| VVi | 0 | 0 | | | | |
| | 8 | | 0 | | | |
| | 40 | | | 0 | | |
| | 168 | f00 | f01 | | 0 | |
| | 255 | f10 | f11 | | | 0 |

DISPLAY DEVICE AND DRIVING METHOD THEREOF

This application claims priority to Korean Patent Application No. 10-2020-0076000, filed on Jun. 22, 2020, and all the benefits accruing therefrom under 35 U.S.C. § 119, the content of which in its entirety is herein incorporated by reference.

BACKGROUND OF THE INVENTION

(a) Field of the Invention

Embodiments according to the present invention relate to a display device and a driving method thereof.

(b) Description of the Related Art

As information technology has developed, the importance of a display device, which is a connection medium between a user and information, has been highlighted. Accordingly, the use of the display device such as a liquid crystal display device, an organic light emitting display device, and a plasma display device has been increasing.

A data driver of the display device may supply data voltages to pixels, and the pixels may emit light with luminance based on the data voltages to display an image. In this case, the pixels may share data lines of the number smaller than the number of pixels, and receive data voltages in a time division manner.

In this case, a data voltage of each pixel may be affected by data voltages of adjacent pixels sharing a data line. To solve this, a method of calculating a compensation gray by comparing grays of adjacent pixels has been proposed.

SUMMARY

However, since the calculated compensation grays are non-linear, it is difficult to apply various gains required according to a structure/driving method of the display device.

Embodiments according to the present invention has been made in an effort to provide a display device and a driving method thereof that may easily apply various gains required according to a structure/driving method of a display device by calculating linear compensation values in a voltage domain.

An embodiment of the present invention provides a display device including: a gray converter which adds compensation grays into input grays to provide output grays; a data driver which provides data voltages corresponding to the output grays; and a display panel which includes pixels which receives the data voltages, where the gray converter may include: a voltage domain converter which converts the input grays into conversion grays; and a compensation gray calculator which calculates the compensation grays based on the conversion grays.

The gray converter may further include a memory which outputs previous conversion grays, and the conversion grays correspond to a current pixel row, and the previous conversion grays correspond to one previous pixel row.

Each of the pixels may be connected to a data line disposed in a first side of the each of the pixels.

The gray converter may further include a memory which outputs previous conversion grays, and the conversion grays correspond to a current pixel row, and the previous conversion grays correspond to two previous pixel rows.

The pixels may include first pixels and second pixels, each of the first pixels may be connected to a data line disposed in a first direction from the each of the first pixels, each of the second pixels may be connected to a data line disposed in a second direction from the each of the second pixels, and the first direction is opposite to the second direction.

The display device may further include a data distributor connected to the data driver through data output lines and connected to the pixels through the data lines, where the number of the data output lines may be smaller the number of the data lines.

The compensation gray calculator may include a lookup table in which compensation values corresponding to some of the previous conversion grays and some of the conversion grays are recorded, and the compensation gray calculator may calculate first interpolated values for some of the pixels by interpolating the compensation values.

The compensation gray calculator may calculate second interpolated values for others of the pixels by interpolating the first interpolated values.

The compensation gray calculator may convert the second interpolated values into values a gray domain to provide the values in the gray domain as the compensation grays.

The gray converter may further include a maximum luminance gain provider which provides a maximum luminance gain based on a maximum luminance, where the compensation gray calculator scales the second interpolated values according to the maximum luminance gain, and converts the scaled second interpolated values into values in a gray domain to provide the values in the gray domain as the compensation grays.

The maximum luminance gain provider may increase the maximum luminance gain as the maximum luminance increases.

The gray converter may further include a connection gain provider which provides connection gains for the first pixels, and the compensation gray calculator may scale the second interpolated values according to the connection gains, and convert the scaled second interpolated values into values in a gray domain to provide the values in the gray domain as the compensation grays.

The connection gain provider may not provide connection gains for the second pixels.

The gray converter may further include an area gain provider which provides area gains based on positions of the pixels, and the compensation gray calculator may scale the second interpolated values according to the area gains, and convert the scaled second interpolated values into values in a gray domain to provide the values in the gray domain as the compensation grays.

The display panel may be divided into a first area, a second area, and a third area; the first area includes pixels at a first pixel density; the second area and the third area may include pixels at a second pixel density higher than the first pixel density; the pixels in the second area and the pixels in the first area may be connected to the same data lines; and the area gain provider may provide a first area gain of the area gains for the pixels in the first area, and a second area gain of the area gains for the pixels in the second area.

Another embodiment of the present provides a driving method of a display device, including: converting input grays into conversion grays in a voltage domain; calculating compensation grays based on the conversion grays; providing output grays by adding the compensation grays to the input grays; and providing data voltages corresponding to the output grays to pixels.

The driving method of the display device may further include referring to a lookup table which records compensation values corresponding to some of previous conversion grays and some of the conversion grays, where the conversion grays correspond to a current pixel row, and the previous conversion grays correspond to two previous pixel rows; and calculating first interpolated values by interpolating the compensation values for some of the pixels.

The driving method of the display device may further include calculating second interpolated values by interpolating the first interpolated values for others of the pixels.

The driving method of the display device may further include providing the second interpolated values as the compensation grays.

The driving method of the display device may further include scaling the second interpolated values according to a maximum luminance gain which increases as a maximum luminance increases; and converting the scaled second interpolated values into values in a gray domain to provide the values in the gray domain as the compensation grays.

The display device and the driving method thereof according to the present invention may easily apply various gains required according to a structure/driving method of the display device by calculating linear compensation values in a voltage domain.

DETAILED DESCRIPTION

Figure 1:
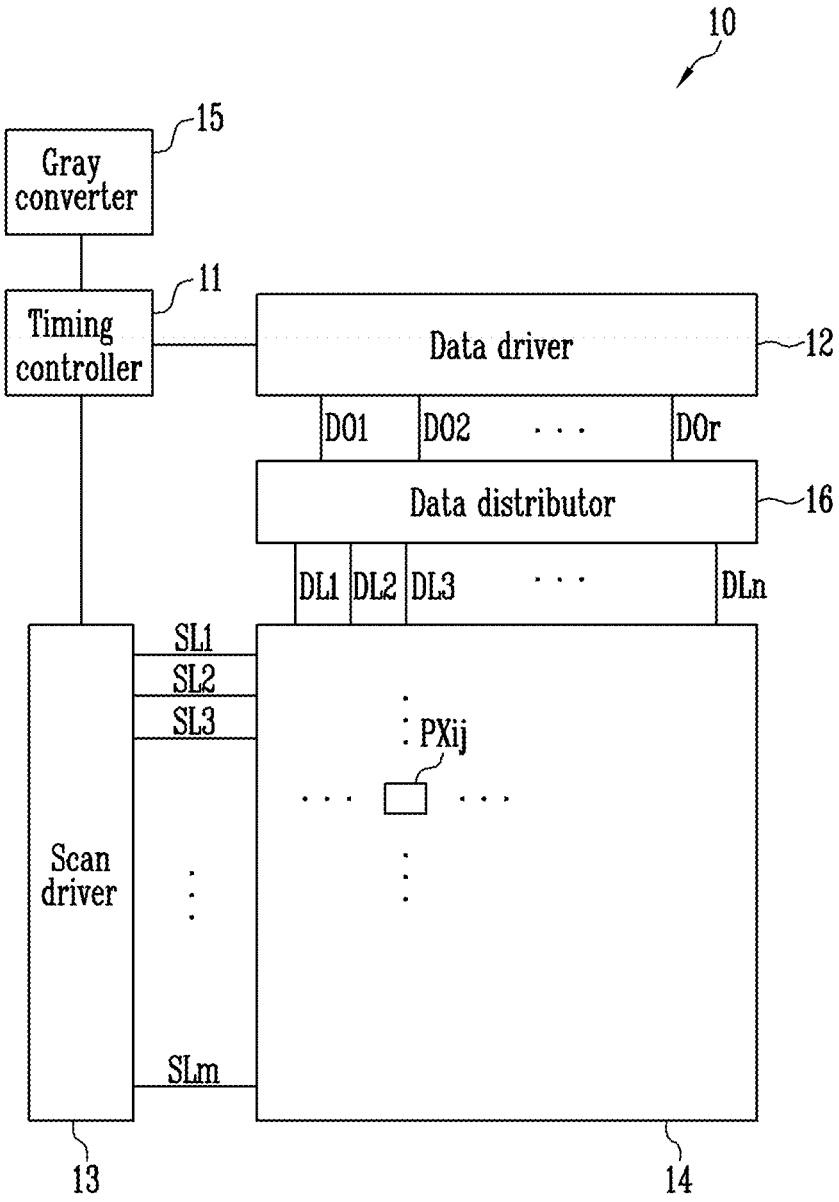
FIG. 1 illustrates a schematic view for explaining a display device according to an embodiment of the present invention.

The present invention will be described more fully hereinafter with reference to the accompanying drawings, in which embodiments of the invention are shown. As those skilled in the art would realize, the described embodiments may be modified in various different ways, all without departing from the spirit or scope of the present disclosure.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Parts that are irrelevant to the description will be omitted to clearly describe the present disclosure, and like reference numerals designate like elements throughout the specification. Therefore, the above-mentioned reference numerals may be used in other drawings.

Further, in the drawings, the size and thickness of each element are arbitrarily illustrated for ease of description, and the present disclosure is not necessarily limited to those illustrated in the drawings. In the drawings, the thicknesses of layers, films, panels, regions, areas, etc. may be exaggerated for clarity.

FIG. 1 illustrates a schematic view for explaining a display device according to an embodiment of the present invention.

Referring to FIG. 1, a display device 10 according to an embodiment of the present invention may include a timing controller 11, a data driver 12, a scan driver 13, a display panel 14, a gray converter 15, and a data distributor 16.

The timing controller 11 may receive input grays and control signals for each frame (or input image) from an external processor. The timing controller 11 may provide control signals suitable for each specification to the data driver 12, and the scan driver 13, and the like for displaying the input image.

The gray converter 15 may add compensation grays to input grays to provide output grays. The timing controller 11 may provide the output grays to the data driver 12. The gray converter 15 may be configured as an integrated chip ("IC") with the timing controller 11 or the data driver 12, or may be configured as a separate independent IC. In another embodiment, the gray converter 15 may be implemented by software in the timing controller 11 or the data driver 12.

The data driver 12 may provide data voltages corresponding to output grays. For example, the data driver 12 may generate data voltages to be provided to data output lines (DO1, DO2, . . . , DOr) using output grays and control signals. For example, the data driver 12 may sample output grays by using a clock signal and apply data voltages corresponding to the output grays to the data output lines DO1 to DOr in units of pixel rows. The pixel row may mean a group of pixels connected to one scan line. r may be an integer greater than zero.

The data distributor 16 may be connected to the data driver 12 through the data output lines DO1 to DOr, and may be connected to pixels through data lines (DL1, DL2, DL3, . . . , DLn). n may be an integer greater than r. The data distributor 16 may be a demultiplexer. The data distributor 16 may selectively connect the data output lines DO1 to DOr to the data lines DL1 to DLn. Each of the data lines DL1 to DLn may receive data voltages from the connected data output lines DO1 to DOr.

The scan driver 13 may receive a clock signal, a scan start signal, and the like from the timing controller 11 to generate scan signals to be provided to scan lines (SL1, SL2, SL3, . . . , SLm). m may be an integer greater than zero.

The scan driver 13 may sequentially supply scan signals having pulses of a turn-on level to the scan lines SL1 to Sm. The scan driver 13 may be configured in a form of a shift register, and may include a plurality of scan stages. The scan driver 13 may generate scan signals in a method of sequentially transmitting a scan start signal having a turn-on level pulse to a next stage according to control of a clock signal.

The display panel 14 includes pixels that receive data voltages. Each pixel PXij may be connected to a corresponding data line and scan line. i and j may be integers greater than zero. A pixel PXij may mean a pixel in which a scan transistor is connected to an i-th scan line and a j-th data line. The pixels may be commonly connected to a first power line ELVDDL and a second power line ELVSSL (see FIG. 2).

Figure 2:
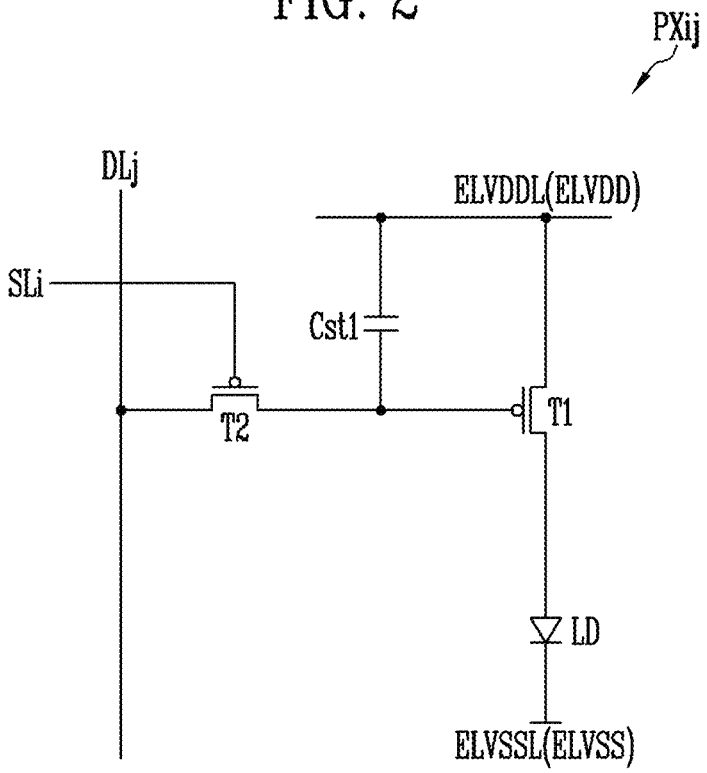
FIG. 2 illustrates a schematic view for explaining a pixel according to an embodiment of the present invention.

FIG. 2 illustrates a schematic view for explaining a pixel according to an embodiment of the present invention.

Referring to FIG. 2, the pixel PXij may be a pixel that emits light of a first color. Pixels emitting light of a second or third color substantially include the same components as the pixel PXij except for a light emitting diode LD, and thus duplicate description is omitted.

In an embodiment, for example, the first color may be one color of red, green, and blue, the second color may be one color of red, green, and blue excluding the first color, and the third color may be the remaining color of red, green, blue excluding the first and second colors. In addition, magenta, cyan, and yellow may be used instead of red, green, and blue as the first to third colors.

The pixel PXij may include a plurality of transistors T1 and T2, a storage capacitor Cst1, and a light emitting diode LD.

In the present embodiment, the transistors are shown as P-type transistors, for example, PMOS transistors, but a person skilled in the art will be able to form a pixel circuit that performs the same function with N-type transistors, for example, NMOS transistors.

A gate electrode of the transistor T2 is connected to a scan line SLi, a first electrode thereof is connected to a data line DLj, and a second electrode thereof is connected to a gate electrode of the transistor T1. The transistor T2 may be referred to as a scan transistor.

The gate electrode of the transistor T1 is connected to the second electrode of the transistor T2, a first electrode thereof is connected to the first power line ELVDDL, and a second electrode thereof is connected to an anode of the light emitting diode LD. The transistor T1 may be referred to as a driving transistor.

The storage capacitor Cst1 connects the first electrode and the gate electrode of the transistor T1.

The anode of the light emitting diode LD is connected to the second electrode of the transistor T1, and a cathode thereof is connected to the second power line ELVSSL. The light emitting diode LD may be an element that emits light having a wavelength corresponding to the first color. The light emitting diode LD may include an organic light emitting diode, or an inorganic light emitting diode such as a micro light emitting diode ("LED"), or a quantum dot light emitting diode. In addition, the light emitting diode LD may be a light emitting element in which an organic material and an inorganic material are combined. In the present embodiment, only one light emitting diode LD is shown, but a plurality of sub light emitting diodes may be connected in series, parallel, or in series-parallel to replace the light emitting diode LD.

When a turn-on level (low level) scan signal is supplied to the gate electrode of the transistor T2 through the scan line SLi, the transistor T2 connects the data line DLj and a first electrode of the storage capacitor Cst1. Therefore, a voltage according to a difference between the data voltage applied through the data line DLj and the first power voltage ELVDD is written to the storage capacitor Cst1.

The transistor T1 allows a driving current determined according to the voltage written to the storage capacitor Cst1 to flow from the first power line ELVDDL to the second power line ELVSSL. The light emitting diode LD emits light with luminance according to an amount of the driving current. The light emitting diodes of the pixels may be connected between the common first and second power line ELVDDL and ELVSSL. Here, the second power line ELVSSL may supply the second power voltage ELVSS.

Figure 3:
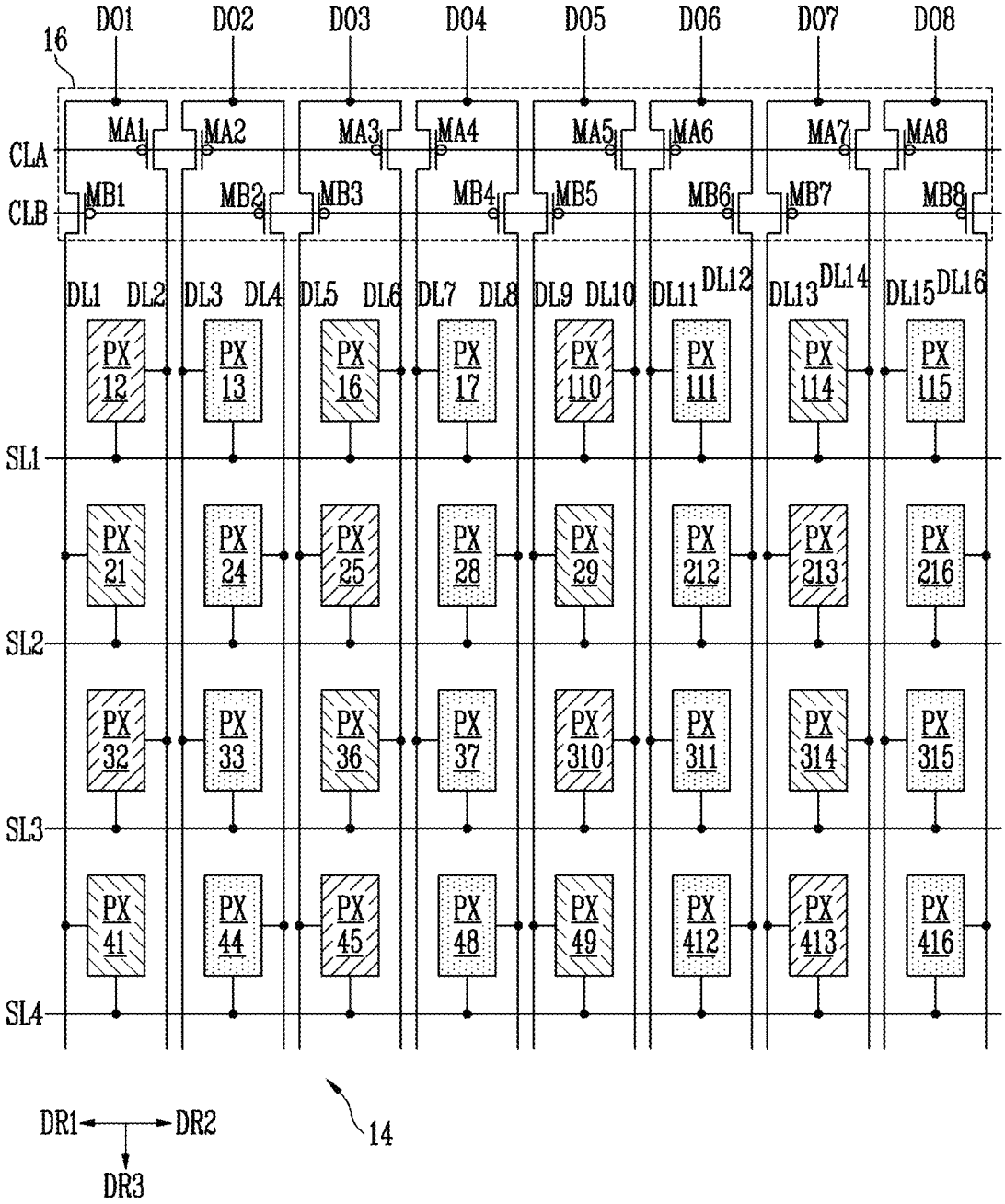
FIG. 3 and FIG. 4 illustrate schematic views for explaining a display panel and a data distributor according to an embodiment of the present invention.
Figure 4:
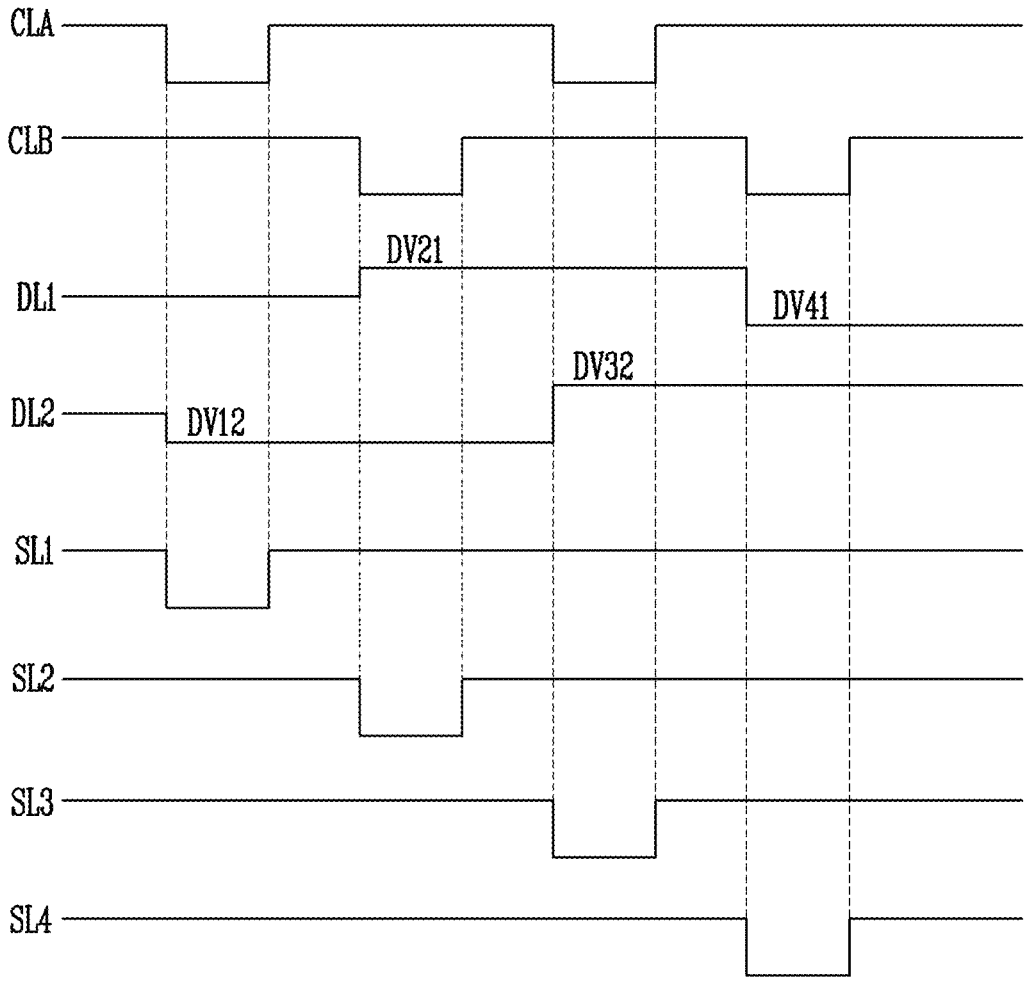

FIG. 3 and FIG. 4 illustrate schematic views for explaining a display panel and a data distributor according to an embodiment of the present invention.

Referring to FIG. 3, the data distributor 16 includes first transistors (MA1, MA2, MA3, MA4, MA5, MA6, MA7, and MA8) and second transistors (MB1, MB2, MB3, MB4, MB5, MB6, MB7, and MB8). Gate electrodes of the first transistors MA1 to MA8 may be connected to a first control line CLA, first electrodes thereof may be connected to data output lines DO1 to DO8, and second electrodes thereof may be connected to first data lines DL2, DL3, DL6, DL7, DL10, D11, DL14, and DL15. Here, the first data lines may be data lines of the following order: 2, 3, 6, 7, 10, 11, 14, 15 . . . . Gate electrodes of the second transistors MB1 to MB8 may be connected to a second control line CLB, first electrodes thereof may be connected to the data output lines DO1 to DO8, and second electrodes thereof may be connected to the second data lines DL1, DL4, DL5, DL8, DL9, DL12, DL13, and DL16. Here, the second data lines may be data lines of the following order: 1, 4, 5, 8, 9, 12, 13, 16 . . . . The number of first transistors MA1 to MA8 and the number of second transistors MB1 to MB8 may be the same. In addition, the number of the first data lines and the number of the second data lines may be the same. The data distributor 16 may be a demultiplexer in which a ratio of an input to an output is 1:2.

A turn-on period of the first transistors MA1 to MA8 may not overlap a turn-on period of the second transistors MB1 to MB8. The timing controller 11 may provide control signals having a turn-on level to the first and second control lines CLA and CLB such that the first transistors MA1 to MA8 and the second transistors MB1 to MB8 may be alternately turned on (see FIG. 4).

In an embodiment, for example, the display panel 14 may include pixels (PX12, PX13, PX16, PX17, PX110, PX111, PX114, PX115, PX21, PX24, PX25, PX28, PX29, PX212, PX213, PX216, PX32, PX33, PX36, PX37, PX310, PX311, PX314, PX315, PX41, PX44, PX45, PX48, PX49, PX412, PX413, PX416), which are arranged in a pentile structure.

The pixels PX12 to PX115 connected to the first scan line SL1 and PX32 to PX315 connected to the third scan line SL3 may be connected to the first data lines. The pixels PX21 to PX216 connected to the second scan line SL2 and PX41 to PX416 connected to the fourth scan line SL4 may be connected to the second data lines. In the present embodiment, odd-numbered pixel rows are connected to the first data lines, and even-numbered pixel rows are connected to the second data lines. In another embodiment, even-number-numbered pixel rows may be connected to the first data lines, and odd-numbered pixel rows may be connected to the second data lines.

In the odd-numbered pixel rows, the pixels may be arranged such that a red color (for example, a pixel PX12), a green color (for example, a pixel PX13), a blue color (for example, a pixel PX16), and a green color (for example, a pixel PX17) may be sequentially repeated along an extending direction of the scan line. The extending direction of the scan line may be a first direction DR1 or a second direction DR2 as shown in FIG. 3. In this case, in the even-numbered pixel rows, the pixels may be arranged such that a blue color (for example, a pixel PX21), a green color (for example, a pixel PX24), a red color (for example, a pixel PX25), and a green color (for example, a pixel PX28) may be sequentially repeated along an extending direction of the scan line. As described above, odd and even numbers may be interchanged in another embodiment.

All pixels connected to one data line may be of the same color. For example, the blue pixels PX21 and PX41 may be connected to the data line DL1. The red pixels PX12 and PX32 may be connected to the data line DL2. The green pixels PX13 and PX33 may be connected to the data line DL3. The extending direction of the data lines DL1 to DL16 may be a third direction DR3. The third direction DR3 may be orthogonal to the first direction DR1 or the second direction DR2.

The pixels PX12 to PX416 may include first pixels PX13, PX17, PX111, PX115, PX21, PX25, PX29, PX213, PX33, PX37, PX311, PX315, PX41, PX45, PX49, and PX413 and second pixels PX12, PX16, PX110, PX114, PX24, PX28, PX212, PX216, PX32, PX36, PX310, PX314, PX44, PX48, PX412, and PX416. Each of the first pixels may be connected to the data line disposed in the first direction DR1 from the each of the first pixels. That is, each of the first pixels may be connected to the data line disposed in the left side of the each of the first pixels. Each of the second pixels may be connected to the data line disposed in the second direction DR2 from the each of the second pixels. That is, each of the second pixels may be connected to the data line disposed in the right side of the each of the first pixels. The first direction DR1 and the second direction DR2 may be opposite to each other.

When the pixels of the display panel 14 are arranged in a matrix form, the first pixels and the second pixels may be alternately arranged in a row direction (the first direction DR1 or the second direction DR2) and a column direction (the third direction DR3).

Referring to FIG. 4, the scan driver 13 may sequentially supply turn-on level scan signals to the scan lines SL1, SL2, SL3, and SL4. When the turn-on level scan signal is supplied to the scan line SL1, a data voltage DV12 for the pixel PX12 may be supplied to the data line DL2. When the turn-on level scan signal is supplied to the scan line SL2, a data voltage DV21 for the pixel PX21 may be supplied to the data line DL1. When the turn-on level scan signal is supplied to the scan line SL3, a data voltage DV32 for the pixel PX32 may be supplied to the data line DL2. When the turn-on level scan signal is supplied to the scan line SL4, a data voltage DV41 for the pixel PX41 may be supplied to the data line DL1.

As the display panel 14 becomes high resolution, a period during which data voltage can be written to each pixel is decreasing. Accordingly, it may occur that a target data voltage is not sufficiently written to the pixel. For example, it is assumed that the data voltage DV32 is greater than the data voltage DV12. In this case, as a difference between the data voltage DV32 and the data voltage DV12 becomes larger, it is possible to compensate the target data voltage DV32 to be written to the pixel PX32 by increasing the data voltage DV32. For example, it is assumed that the data voltage DV41 is smaller than the data voltage DV21. In this case, as a difference between the data voltage DV41 and the data voltage DV21 becomes larger, it is possible to compensate the target data voltage DV41 to be written to the pixel PX41 by decreasing the data voltage DV41. The compensation may be performed by converting input grays GVi into output grays GVo by the gray converter 15 (to be described later).

Figure 5:
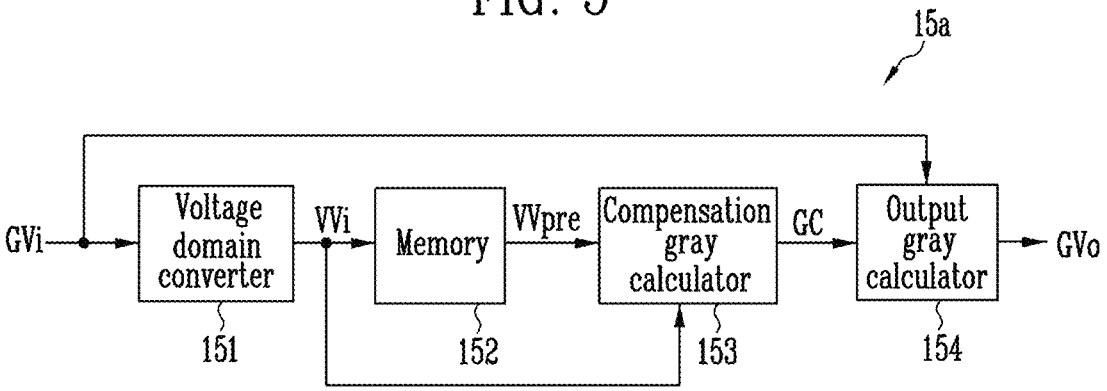
FIG. 5 illustrates a schematic view of a gray converter according to an embodiment of the present invention.
Figure 6:
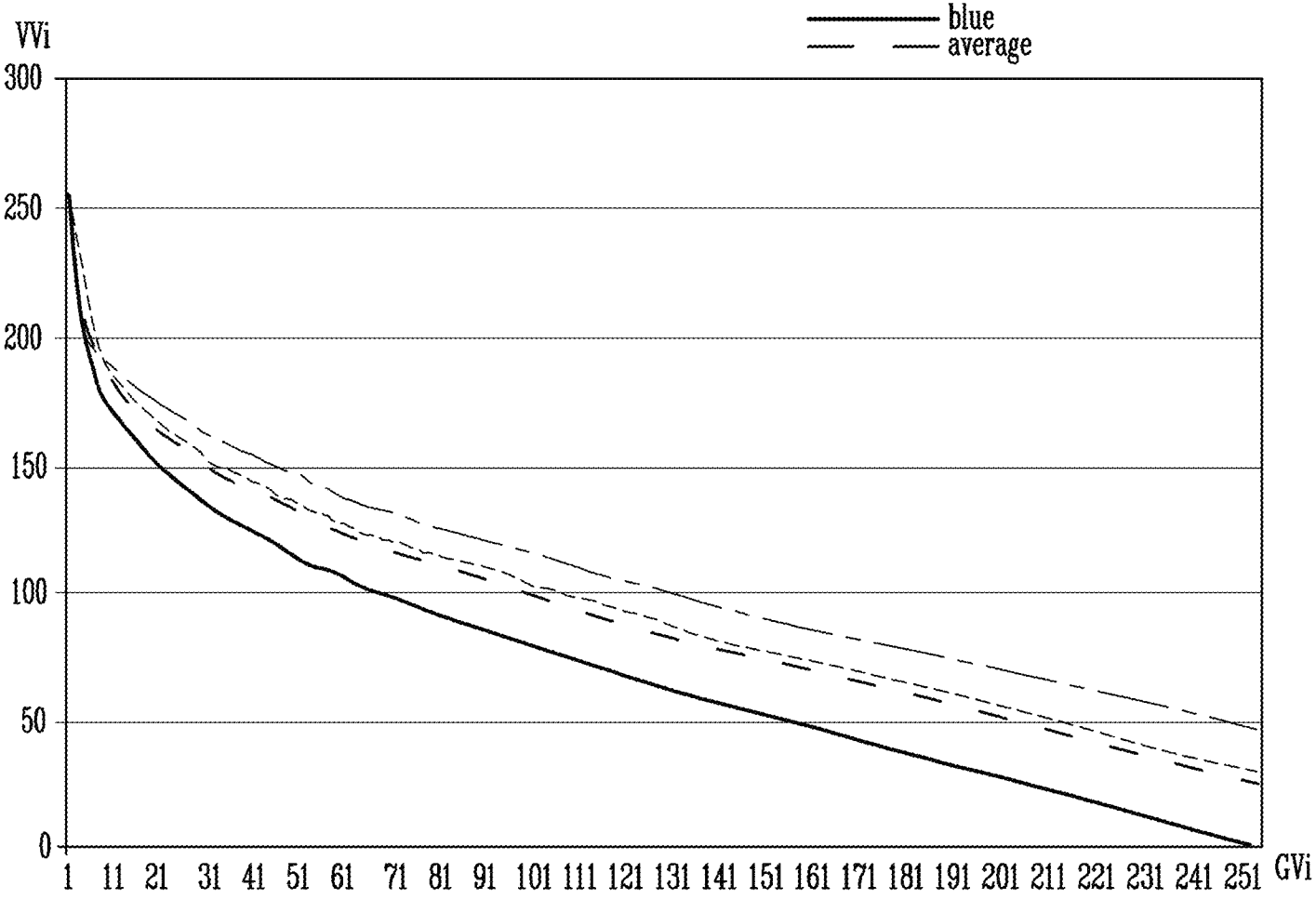
FIG. 6 illustrates a graph for explaining a data conversion operation of a voltage domain converter according to an embodiment of the present invention.
Figure 7:
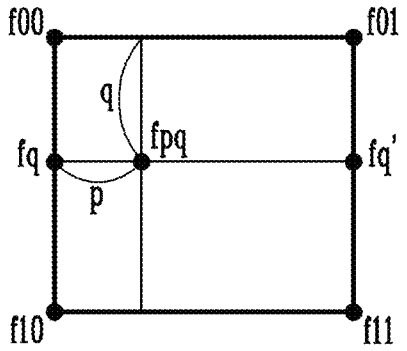
FIG. 7 and FIG. 8 illustrate schematic views for explaining calculation operations of a compensation gray calculator according to an embodiment of the present invention.
Figure 8:
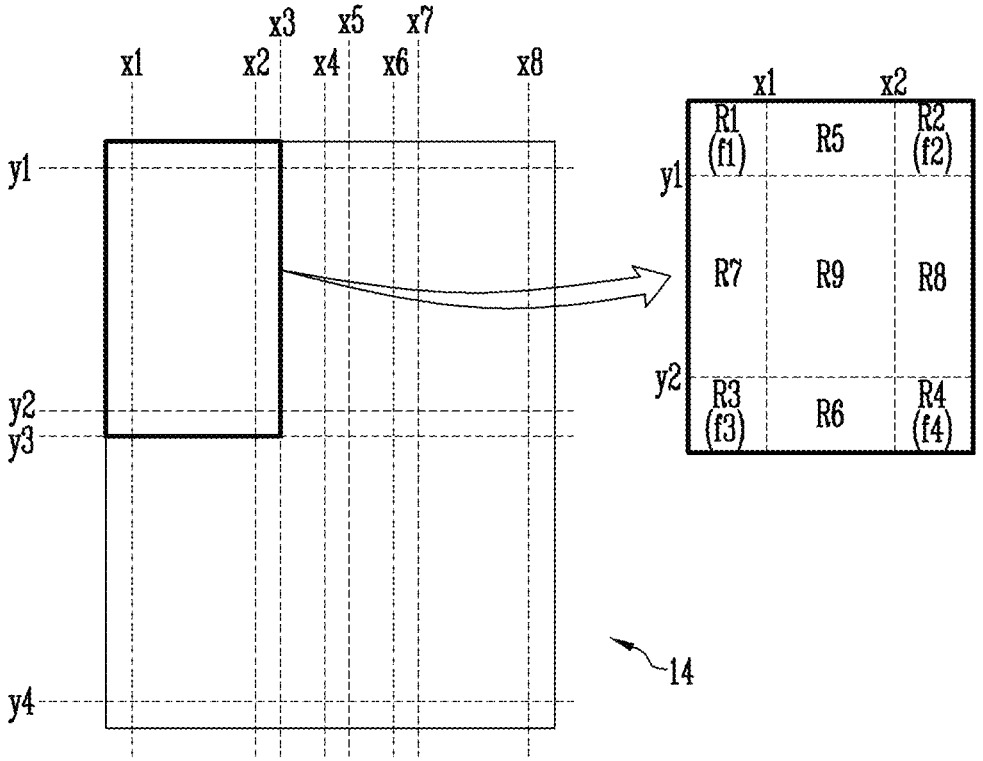

FIG. 5 illustrates a schematic view of a gray converter according to an embodiment of the present invention. FIG. 6 illustrates a graph for explaining a data conversion operation of a voltage domain converter according to an embodiment of the present invention. FIG. 7 and FIG. 8 illustrate schematic views for explaining calculation operations of a compensation gray calculator according to an embodiment of the present invention.

Referring to FIG. 5, a gray converter 15*a* according to an embodiment of the present invention may include a voltage domain converter 151, a memory 152, a compensation gray calculator 153, and an output gray calculator 154.

The voltage domain converter 151 may convert the input grays GVi into conversion grays VVi in a voltage domain. Referring to FIG. 6, graphs in which a horizontal axis is the input grays GVi and a vertical axis is the conversion grays VVi are shown. The voltage domain conversion may be independently performed for each color (red, green, blue). The voltage domain converter 151 may include at least some of the graphs of FIG. 6 as mapping data. The voltage domain converter 151 may convert the input grays GVi into the conversion grays VVi in the voltage domain by using the mapping data.

Referring to the graphs of FIG. 6, the higher the input grays GVi is, the lower the conversion grays VVi may be. This case may correspond to a case in which the transistor T1, which is the driving transistor of the pixel PXij shown in FIG. 2, is configured as a P type. If the driving transistor of the pixel PXij is configured as an N type, the higher the input grays GVi is, the higher the conversion grays Wi may be. Slopes of the graphs in FIG. 6 may be based on a gamma value of a gamma curve applied to the display device 10.

Figure 17:
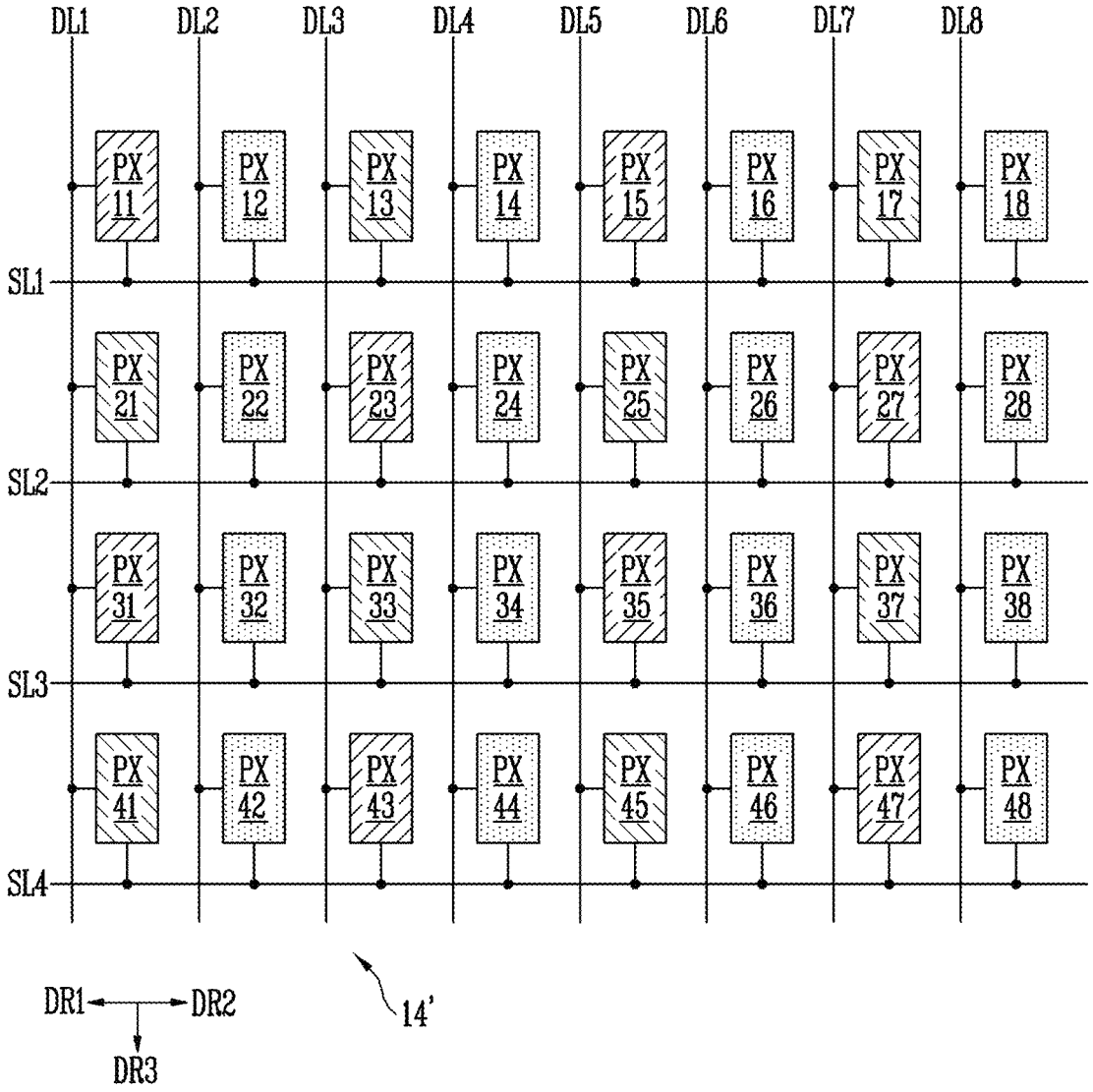
FIG. 17 illustrates a schematic view for explaining a display panel according to another embodiment of the present invention.

The memory 152 may output previous conversion grays VVpre corresponding to a previous pixel row. When the structure of the display panel 14 is one as illustrated in FIG. 3, the memory 152 may output previous conversion grays VVpre corresponding to two previous pixel rows. However, when the structure of the display panel 14 is one as illustrated in FIG. 17 (to be described later), the memory 152 may output previous conversion grays VVpre corresponding to one previous pixel rows.

The compensation gray calculator 153 may calculate compensation grays GC based on the conversion grays Wi.

The compensation gray calculator 153 may calculate the compensation grays GC by comparing the conversion grays VVi with the previous conversion grays VVpre.

Referring to FIG. 7, the compensation gray calculator 153 may include a lookup table LUT in which compensation values (f00, f01, f10, f11, . . . ) corresponding to some of the previous conversion grays VVpre and some of the conversion grays Wi are recorded. The lookup table LUT may be provided for each color. For example, the compensation gray calculator 153 may include a lookup table for red pixels, a lookup table for green pixels, and a lookup table for blue pixels.

The compensation gray calculator 153 may interpolate the compensation values (f00, f01, f10, f11, . . . ) for some of the pixels to calculate first interpolated values. In this case, a bi-linear interpolation may be used.

In an embodiment, for example, it is assumed that the lookup table LUT includes the compensation values (f00, f01, f10, f11, . . . ) corresponding to 0, 8, 40, 168, 255 of grays of the previous conversion grays VVpre and 0, 8, 40, 168, 255 of grays of the (current) conversion grays VVi. In this case, it is assumed that the previous conversion gray VVpre is 2, and the conversion gray VVi is 208. In this case, p may be 2−0=2, and q may be 208−168=40. In this case, Exemplary Equation 1 for obtaining a target first interpolated value fpq is as follows.

[Equation 1]

$$fpq = f00 + a*p + b*q + c*p*q = f00 + (f01 - f00)*\frac{p}{LPP} + (f10 - f00)*\frac{q}{LPQ} + (f00 + f11 - f01 - f10)*\frac{p*q}{LPP*LPQ}$$

Here, LPP may be a maximum value of p, and LPQ may be a maximum value of q. In this example, LPP may be 8−0=8, and LPQ may be 255−168=87.

Referring to FIG. 8, it is assumed that the first interpolated values (f1, f2, f3, f4, . . . ) are calculated for representative pixels of boundary regions R1, R2, R3, and R4 of the display panel 14. The first interpolated values (f1, f2, f3, f4, . . . ) calculated for the representative pixels may be equally applied to other pixels included in each of the boundary regions R1, R2, R3, and R4. This is based on precondition in which the grays in a sufficiently narrow region are substantially the same. Exemplary Equation 2 is as follows.

[Equation 2]

$$fxy = fpq(R1),\ \text{if } x \le x1 \text{ and } y \le y1 \quad [R1]$$

$$= fpq(R2),\ \text{if } x \ge x2 \text{ and } y \le y1 \quad [R2]$$

$$= fpq(R3),\ \text{if } x \le x1 \text{ and } y \ge y2 \quad [R3]$$

$$= fpq(R4),\ \text{if } x \ge x1 \text{ and } y \ge y2 \quad [R4]$$

In this case, x and y may be coordinates of pixels to be calculated in the second direction DR2 and the third direction DR3, respectively. x1, x2, y1, and y2 may be boundary coordinates of the boundary regions R1, R2, R3, and R4 and intermediate regions R5, R6, R7, R8, and R9. fpq(R1) is a first interpolated value of the representative pixel of the boundary region R1, fpq(R2) is a first interpolated value of the representative pixel of the boundary region R2, fpq(R3) is a first interpolated value of the representative pixel of the boundary region R3, and fpq(R4) is a first interpolated value of the representative pixel in the boundary region R4. fxy is a second interpolated value of a pixel to be calculated.

The compensation gray calculator 153 may interpolate the first interpolated values (f1, f2, f3, f4, . . . ) to calculate second interpolated values for others of the pixels. For example, the compensation gray calculator 153 may interpolate the first interpolated values (f1, f2, f3, f4, . . . ) with respect to the intermediate regions (R5, R6, R7, R8, and R9) of the boundary regions (R1, R2, R3, and R4) to calculate the second interpolated values. Exemplary Equation 3 is as follows.

[Equation 3]

$$fxy = fpq(R1) + \frac{x - x1}{x2 - x1}*(fpq(R2) - fpq(R1)),\ \text{if } x1 < x < x2 \text{ and } y < y1 \quad [R5]$$

$$= fpq(R3) + \frac{x - x1}{x2 - x1}*(fpq(R4) - fpq(R3)),\ \text{if } x1 < x < x2 \text{ and } y > y2 \quad [R6]$$

$$= fpq(R1) + \frac{y - y1}{y2 - y1}*(fpq(R3) - fpq(R1)),\ \text{if } x < x1 \text{ and } y1 < y < y2 \quad [R7]$$

$$= fpq(R2) + \frac{y - y1}{y2 - y1}*(fpq(R4) - fpq(R2)),\ \text{if } x2 < x \text{ and } y1 < y < y2 \quad [R8]$$

$$= fpq(R1) + \frac{x - x1}{x2 - x1}*(fpq(R2) - fpq(R1)) + \frac{y - y1}{y2 - y1}*(fpq(R3) - fpq(R1)) + \frac{x - x1}{x2 - x1}*\frac{y - y1}{y2 - y1}*(fpq(R1) + fpq(R4) - fpq(R2) - fpq(R3)),\ \text{else} \quad [R9]$$

The compensation gray calculator 153 may convert the second interpolated values fxy into values in a gray domain and provide them as the compensation grays GC.

The output gray calculator 154 may add the compensation grays GC to the input grays GVi to provide the output grays GVo.

The gray converter 15*a* according to the present embodiment may use linear interpolation for gray/position by calculating linear compensation values (f00, f01, f10, f11, . . . ) in the voltage domain, and thus, costs for memory and computation may be reduced.

Figure 9:
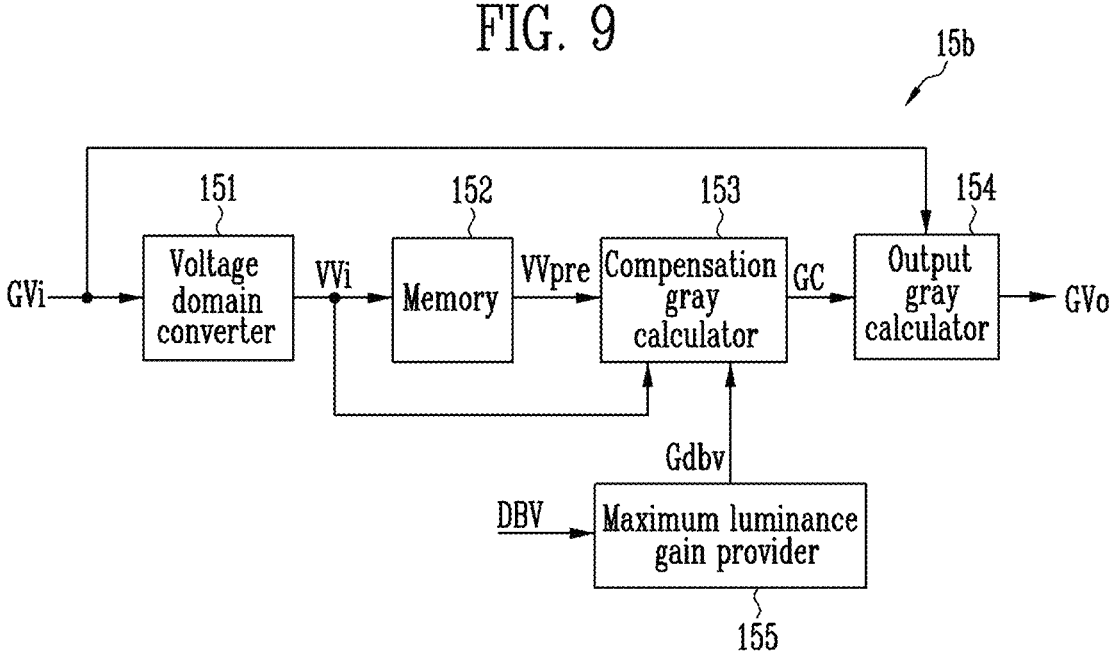
FIG. 9 and FIG. 10 illustrate schematic views for explaining a maximum luminance gain provider according to an embodiment of the present invention.
Figure 10:
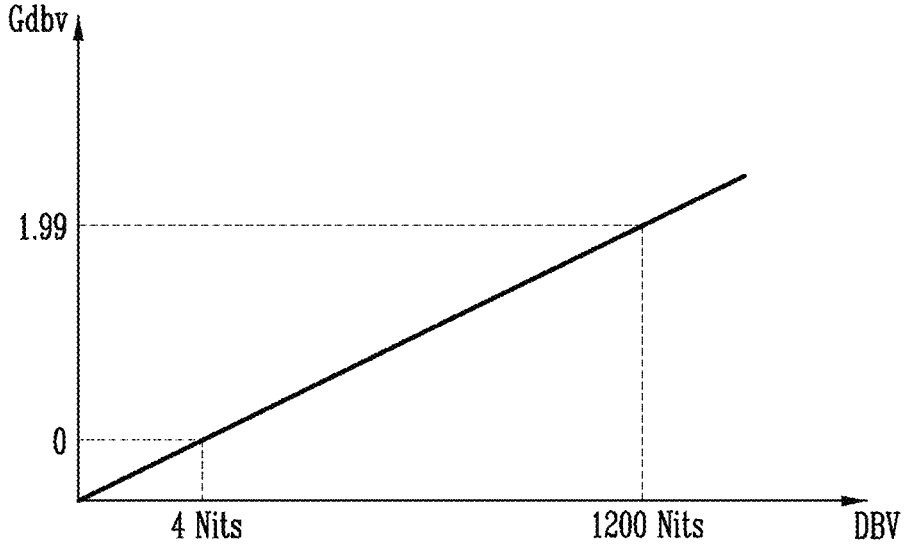

FIG. 9 and FIG. 10 illustrate schematic views for explaining a maximum luminance gain provider according to an embodiment of the present invention.

Referring to FIG. 9, a gray converter 15*b* according to an embodiment of the present invention may further include a maximum luminance gain provider 155 based on the gray converter 15*a*.

The maximum luminance gain provider 155 may provide a maximum luminance gain Gdbv based on a maximum luminance DBV. The maximum luminance DBV may be a luminance value of light emitted from the pixels corresponding to the maximum gray (for example, gray is 255). For example, it may be a luminance value of white light generated by a red pixel emitting light corresponding to 255 of gray, a green pixel emitting light corresponding to 255 of gray, and a blue pixel emitting light corresponding to 255 of gray, where the red, green, and blue pixels form one dot. A unit of luminance value may be Nits. Accordingly, the display panel 14 may display a partially (spatially) dark or light image frame, but a maximum brightness of the image frame is limited to the maximum luminance DBV. The maximum luminance DBV may be manually set by a user's manipulation of the display device 10, or may be automatically set by an algorithm associated with an illuminance sensor or the like. Even if the gray is the same, when the maximum luminance DBV is changed, a data voltage corresponding to the gray is changed, so the luminance of the pixel is also changed.

The maximum luminance gain provider 155 may increase the maximum luminance gain Gdbv as the maximum luminance DBV increases. Referring to FIG. 10, for example, when the maximum luminance DBV is 4 Nits, the maximum luminance gain Gdbv may be set to 0. For example, when the maximum luminance DBV is 1200 Nits, the maximum luminance gain Gdbv may be set to 1.99.

The compensation gray calculator 153 may scale the second interpolated values fxy according to the maximum luminance gain Gdbv. For example, the compensation gray calculator 153 may scale the second interpolated values fxy by multiplying the second interpolated values fxy by the maximum luminance gain Gdbv. The compensation gray calculator 153 may convert the scaled second interpolated values fxy into a gray domain and provide them as the compensation grays GC.

According to the present embodiment, by calculating linear compensation values in the voltage domain, since simple multiplication operation of the maximum luminance gain Gdbv is possible, costs for memory and computation may be reduced.

Figure 11:
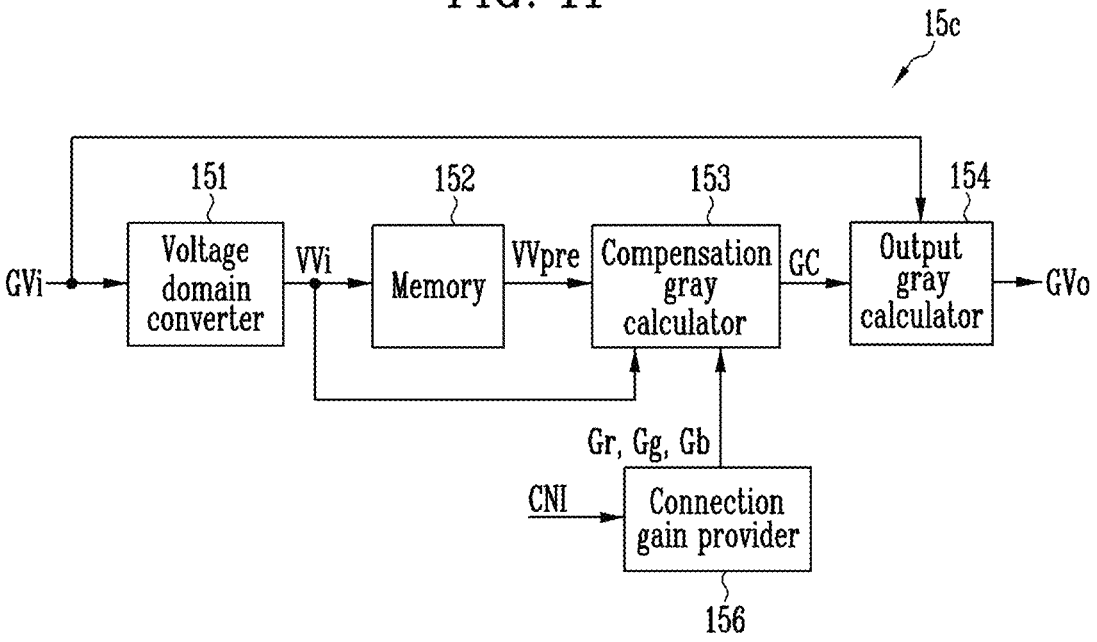
FIG. 11 and FIG. 12 illustrate schematic views for explaining a connection gain provider according to an embodiment of the present invention.
Figure 12:
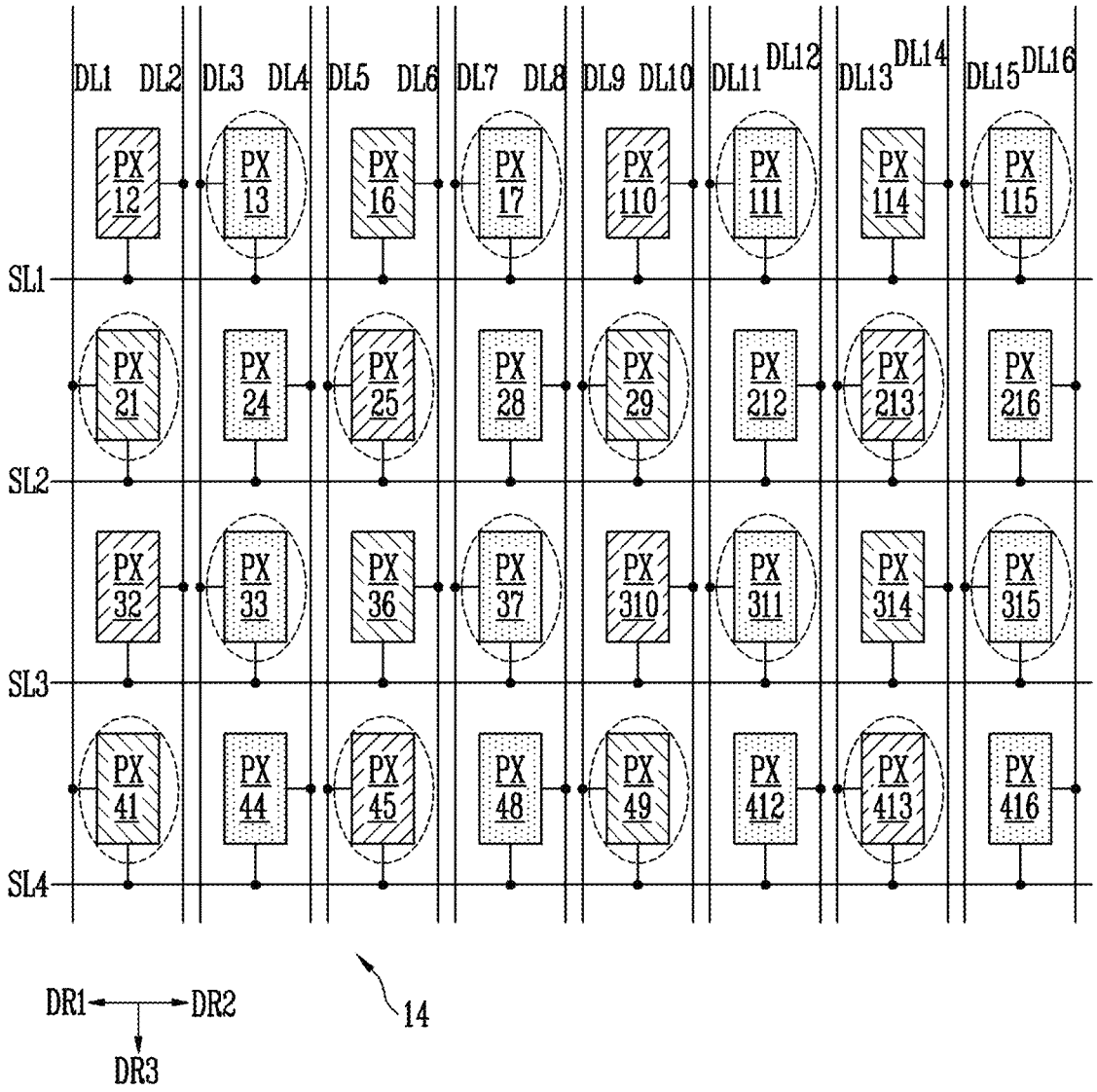

FIG. 11 and FIG. 12 illustrate schematic views for explaining a connection gain provider according to an embodiment of the present invention.

Referring to FIG. 11, a gray converter 15*c* according to an embodiment of the present invention may further include a connection gain provider 156.

The connection gain provider 156 may provide connection gains Gr, Gg, and Gb for the first pixels. In the embodiment, the connection gain provider 156 may not provide connection gains for the second pixels. In another embodiment, the connection gain provider 156 may provide connection gains for the second pixels, and, in this case, may provide connection gains different from the connection gains Gr, Gg, and Gb for the first pixels. The connection gain provider 156 may receive connection information CNI to determine whether the pixels are included in the first or second pixels.

Referring to FIG. 12, as described with reference to FIG. 3, each of the first pixels PX13, PX17, PX111, PX115, PX21, PX25, PX29, PX213, PX33, PX37, PX311, PX315, PX41, PX45, PX49, PX413 may be connected to a data line disposed in the first direction DR1 based on each of the first pixels PX13 to PX413. Each of the second pixels PX12, PX16, PX110, PX114, PX24, PX28, PX212, PX216, PX32, PX36, PX310, PX314, PX44, PX48, PX412, PX416 may be connected to a data line disposed in the second direction DR2 based on each of the second pixels. The first direction DR1 and the second direction DR2 may be opposite to each other.

All pixels of the display panel 14 may have the same pixel circuit structure. In this case, a data line connected to a left side (for example, the first direction DR1) of the pixel circuit and a data line connected to a right side (for example, the second direction DR2) of the pixel circuit may have different parasitic capacitances. Therefore, according to the present embodiment, by providing the connection gains Gr, Gg, and Gb according to the arrangement of data lines and pixels, compensation for the structure of the display panel 14 may be performed. The connection gains Gr, Gg, and Gb may be provided differently for each color.

The compensation gray calculator 153 may scale the second interpolated values fxy according to the connection gains Gr, Gg, and Gb. For example, the compensation gray calculator 153 may scale the second interpolated values fxy by multiplying the second interpolated values fxy by the connection gains Gr, Gg, and Gb. The compensation gray calculator 153 may convert the scaled second interpolated values fxy into a gray domain and provide them as the compensation grays GC.

According to the present embodiment, by calculating linear compensation values in the voltage domain, since simple multiplication operation of the connection gains Gr, Gg, and Gb is possible, costs for memory and computation may be reduced.

Figure 13:
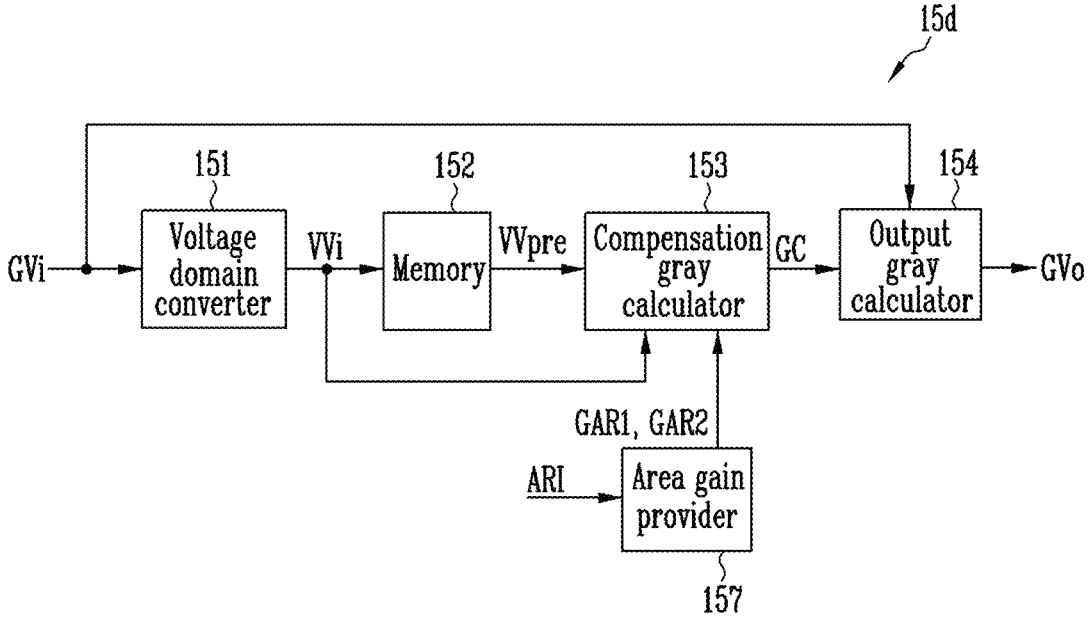
FIG. 13 and FIG. 14 illustrate schematic views for explaining an area gain provider according to an embodiment of the present invention.
Figure 14:
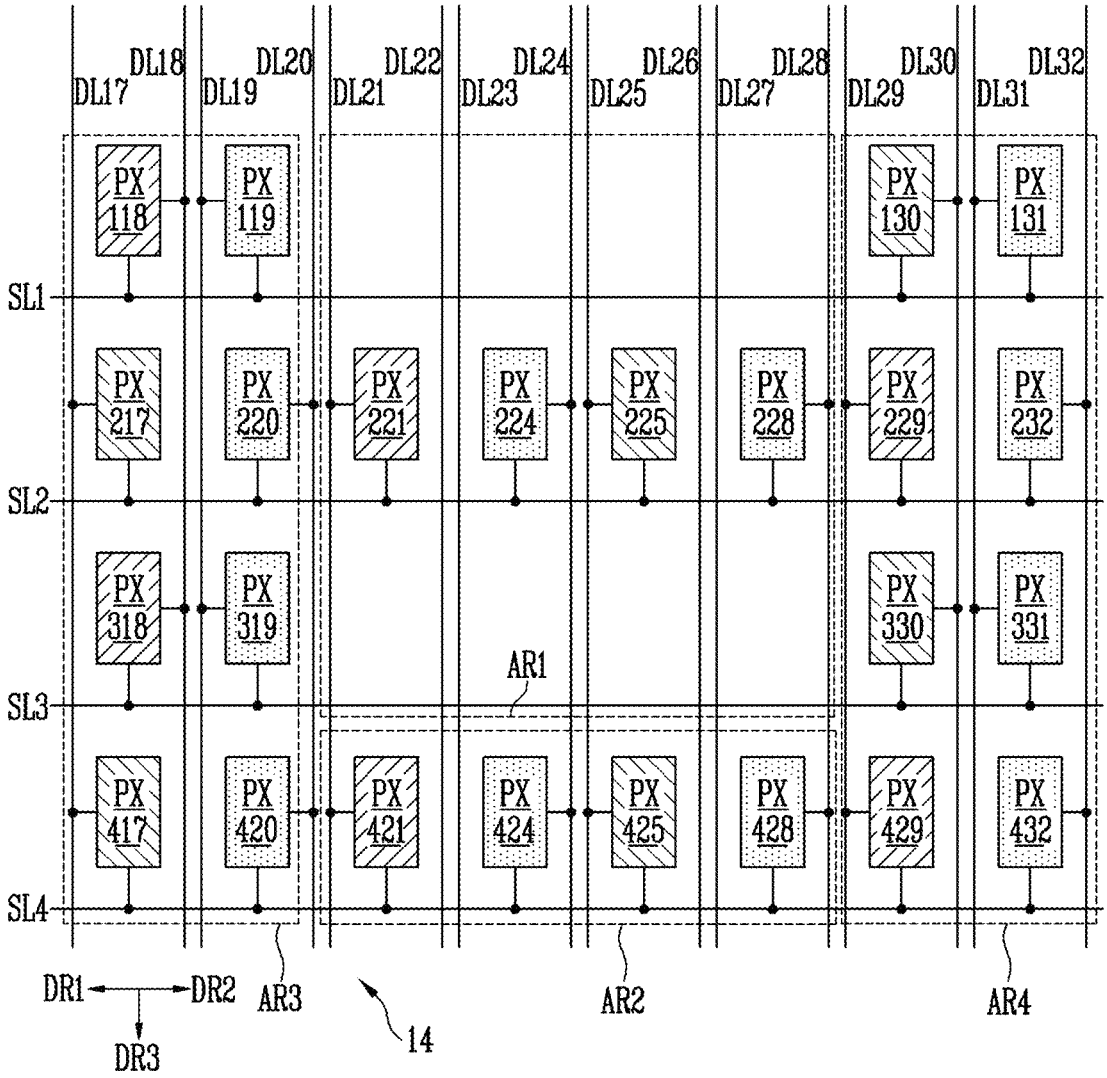

FIG. 13 and FIG. 14 illustrate schematic views for explaining an area gain provider according to an embodiment of the present invention.

Referring to FIG. 13, the gray converter 15*d* according to an embodiment of the present invention may further include an area gain provider 157 based on the gray converter 15*a*.

Referring to FIG. 13, the area gain provider 157 may provide area gains GAR1 and GAR2 based on positions of the pixels.

Referring to FIG. 14, the display panel 14 may be divided into a first area AR1, a second area AR2, and a third area AR3. Since a fourth area AR4 may be treated in the same way as the third area AR3, a duplicate description is omitted. In addition, since an area of FIG. 3 of the display panel 14 may also be treated in the same manner as the third area AR3, a duplicate description is omitted.

The first area AR1 may include pixels at a first pixel density. The second area AR2 and the third area AR3 may include pixels at a second pixel density higher than the first pixel density. That is, the number of pixels per unit area of the second area AR2 and the third area AR3 may be greater than the number of pixels per unit area of the first area AR1.

In an embodiment, for example, the first area AR1 may include transmissive areas through which light may transmit because pixels do not exist. Various devices, such as an image sensor, a camera, a fingerprint sensor, and a proximity sensor, may be arranged to overlap the transmissive areas in a plan view.

Pixels PX421, PX424, PX425, and PX428 of the second area AR2 and pixels PX221, PX224, PX225, and PX228 of the first area AR1 may be connected to the same data lines DL21, DL24, DL25, and DL28. Accordingly, the number of pixels connected to each of the data lines DL21 to DL28 of the second area AR2 is fewer than the number of pixels connected to each of the data lines DL17 to DL20 of the third area AR3. Accordingly, a load of each of the data lines DL21 to DL28 of the second area AR2 is smaller than that of each of the data lines DL17 to DL20 of the third area AR3. Accordingly, a second area gain GAR2 for load compensation is required for the pixels PX421 to PX428 of the second area AR2.

For the same reason, a load of each of the data lines DL21 to DL28 of the first area AR1 is smaller than that of each of the data lines DL17 to DL20 of the third area AR1, and a first area gain GAR1 for compensating the load of the first area AR1 is required. However, since a density of the pixels in the first area AR1 is relatively small, the first area AR1 emits light with a lower luminance for the same data voltage. Accordingly, since luminance compensation should be further applied to the first area gain GAR1, the first area gain GAR1 and the second area gain GAR2 may be different from each other. However, relative sizes and the like of the area gains GAR1 and GAR2 may be changed according to a specification of the display device 10. In the third area AR3, a separate area gain may not be necessary.

Accordingly, the area gain provider 157 may provide the first area gain GAR1 for the pixels of the first area AR1 and the second area gain GAR2 for the pixels of the second area AR2. The area gain provider 157 may receive area information ARI to determine whether the pixels are included in the first area AR1, the second area AR2, or the third area AR3.

The compensation gray calculator 153 may scale the second interpolated values fxy according to the area gains GAR1 and GAR2. For example, the compensation gray calculator 153 may scale the second interpolated values fxy by multiplying the second interpolated values fxy by the area gains GAR1 and GAR2. The compensation gray calculator 153 may convert the scaled second interpolated values fxy into a gray domain and provide them as the compensation grays GC.

According to the present embodiment, by calculating linear compensation values in the voltage domain, since simple multiplication operation of the area gains GAR1 and GAR2 is possible, costs for memory and computation may be reduced.

Figure 15:
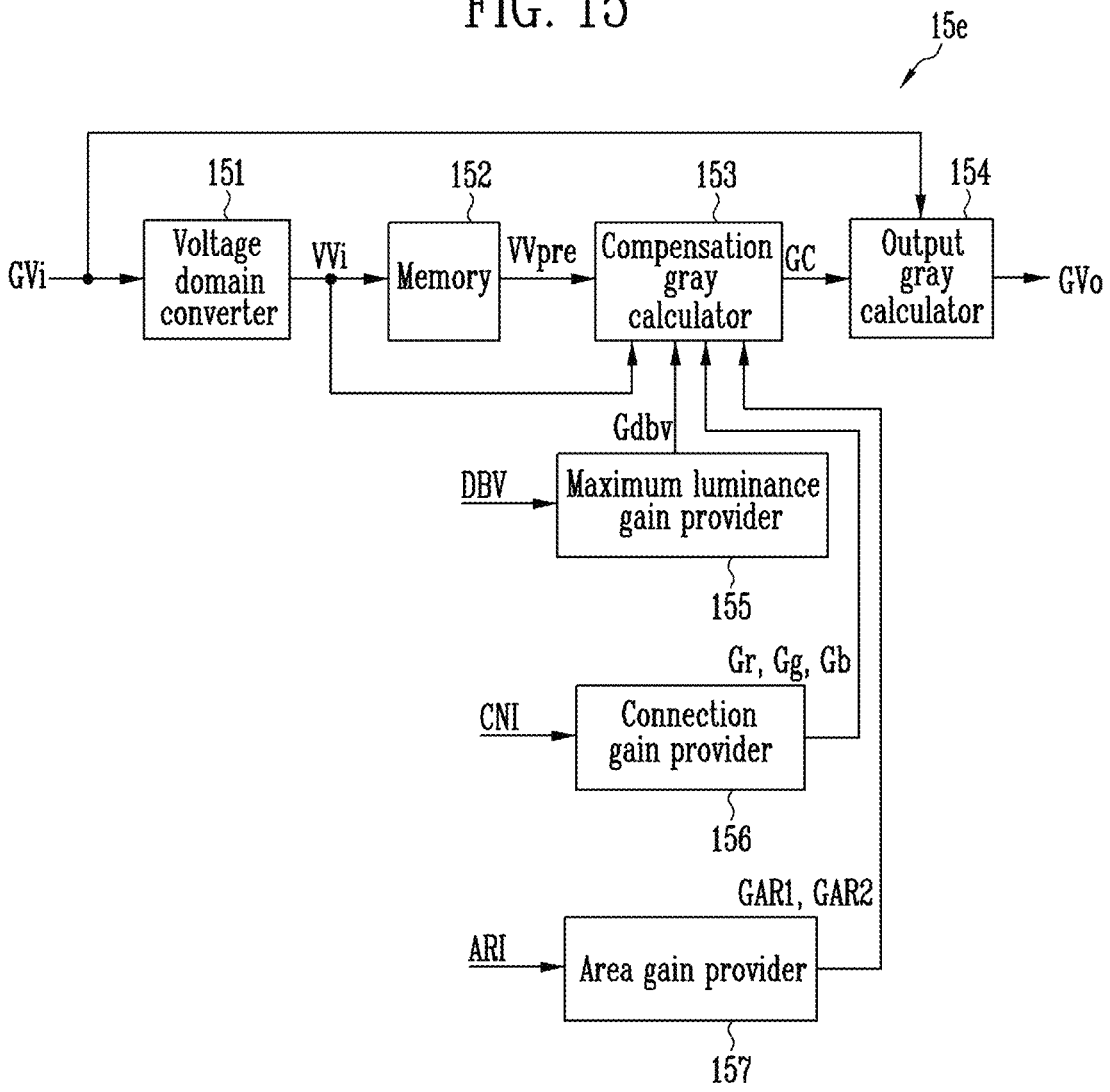
FIG. 15 illustrates a schematic view for explaining a gray converter according to another embodiment of the present invention.

FIG. 15 illustrates a schematic view for explaining a gray converter according to another embodiment of the present invention.

Referring to FIG. 15, a gray converter 15*e* according to an embodiment of the present invention may further include the maximum luminance gain provider 155, the connection gain provider 156, and the area gain provider 157 based on the gray converter 15*a*. Since the maximum luminance gain provider, the connection gain provider 156, and the area gain provider 157 are the same as described above, a duplicate description is omitted.

The compensation gray calculator 153 may scale the second interpolated values fxy according to the maximum luminance gain Gdbv, the connection gains Gr, Gg, and Gb, and the area gains GAR1 and GAR2. For example, the compensation gray calculator 153 may scale the second interpolated values fxy by multiplying the second interpolated values fxy by the maximum luminance gain Gdbv, the connection gains Gr, Gg, and Gb, and the area gains GAR1 and GAR2. The compensation gray calculator 153 may convert the scaled second interpolated values fxy into a gray domain and provide them as the compensation grays GC.

According to the present embodiment, by calculating linear compensation values in the voltage domain, since simple multiplication operation of the maximum luminance gain Gdbv, the connection gains Gr, Gg, and Gb, and the area gains GAR1 and GAR2 is possible, costs for memory and computation may be reduced.

Figure 16:
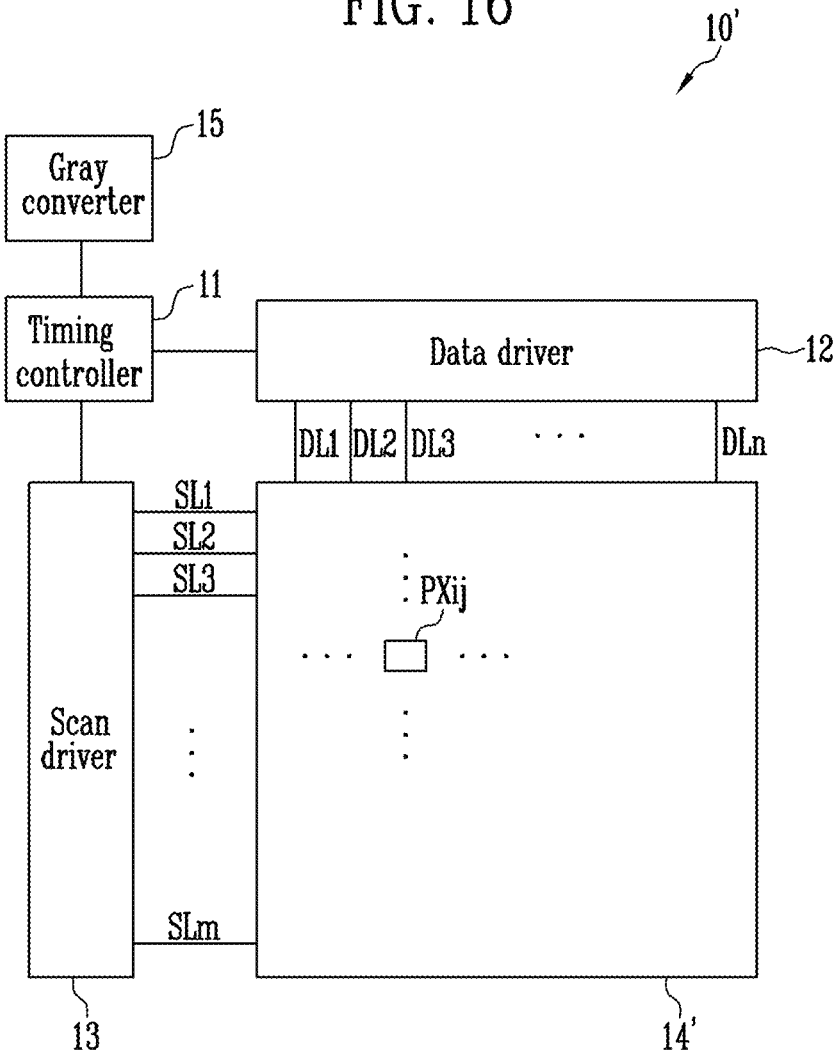
FIG. 16 illustrates a schematic view for explaining a display device according to another embodiment of the present invention.

FIG. 16 illustrates a schematic view for explaining a display device according to another embodiment of the present invention. FIG. 17 illustrates a schematic view for explaining a display panel according to another embodiment of the present invention.

Referring to FIG. 16, a display device 10' according to another embodiment of the present invention is different from the display device 10 in that it does not include the data distributor 16. In addition, a structure of a display panel 14' is different from that of the display panel 14.

Referring to FIG. 17, each of the pixels PX11 to PX48 is connected to a data line disposed in the first direction DR1 based on each of the pixels PX11 to PX48. Accordingly, since the connection information CNI is unnecessary, the gray converter 15 may not include the connection gain provider 156. In some embodiments, the gray converter 15 may optionally include the maximum luminance gain provider 155 and the area gain provider 157.

As described above, in the case of FIG. 17, the memory 152 may output previous conversion grays VVpre corresponding to one previous pixel rows.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, those skilled in the art will understand that various modifications and other equivalent embodiments of the present invention are possible. Consequently, the true technical protective scope of the present invention must be determined based on the technical spirit of the appended claims.

What is claimed is:

1. A display device comprising:

a gray converter which adds compensation grays to input grays to provide output grays;

a data driver which provides data voltages corresponding to the output grays; and a display panel which includes pixels which receives the data voltages, wherein the gray converter includes:

a voltage domain converter which converts the input grays into conversion grays;

a memory which outputs previous conversion grays; and a compensation gray calculator which calculates the compensation grays based on the conversion grays, wherein the conversion grays correspond to a current pixel row, and the previous conversion grays correspond to two previous pixel rows, the compensation gray calculator includes a lookup table in which compensation values corresponding to some of the previous conversion grays and some of the conversion grays are recorded, and the compensation gray calculator calculates first interpolated values for some of the pixels by interpolating the compensation values.

2. The display device of claim 1, wherein the pixels include first pixels and second pixels, each of the first pixels is connected to a data line disposed in a first direction from the each of the first pixels, each of the second pixels is connected to a data line disposed in a second direction from the each of the second pixels, and the first direction is opposite to the second direction.

3. The display device of claim 2, further comprising a data distributor connected to the data driver through data output lines and connected to the pixels through the data lines, wherein the number of the data output lines is smaller than the number of the data lines.

4. The display device of claim 2, wherein the compensation gray calculator calculates second interpolated values for others of the pixels by interpolating the first interpolated values.

5. The display device of claim 4, wherein the compensation gray calculator converts the second interpolated values into values in a gray domain to provide the values in the gray domain as the compensation grays.

6. The display device of claim 4, wherein the gray converter further includes a maximum luminance gain provider which provides a maximum luminance gain based on a maximum luminance, wherein the compensation gray calculator scales the second interpolated values according to the maximum luminance gain, and converts the scaled second interpolated values into values in a gray domain to provide the values in the gray domain as the compensation grays.

7. The display device of claim 6, wherein the maximum luminance gain provider increases the maximum luminance gain as the maximum luminance increases.

8. The display device of claim 4, wherein the gray converter further includes a connection gain provider which provides connection gains for the first pixels, and the compensation gray calculator scales the second interpolated values according to the connection gains, and converts the scaled second interpolated values into values in a gray domain to provide the values in the gray domain as the compensation grays.

9. The display device of claim 8, wherein the connection gain provider does not provide connection gains for the second pixels.

10. The display device of claim 4, wherein the gray converter further includes an area gain provider which provides area gains based on positions of the pixels, and the compensation gray calculator scales the second interpolated values according to the area gains, and converts the scaled second interpolated values into values in a gray domain to provide the values in the gray domain as the compensation grays.

11. The display device of claim 10, wherein the display panel is divided into a first area, a second area, and a third area;

the first area includes pixels at a first pixel density;

the second area and the third area include pixels at a second pixel density higher than the first pixel density;

the pixels in the second area and the pixels in the first area are connected to same data lines; and the area gain provider provides a first area gain of the area gains for the pixels in the first area, and a second area gain of the area gains for the pixels in the second area.

12. A driving method of a display device, comprising:

converting input grays into conversion grays in a voltage domain;

calculating compensation grays based on the conversion grays;

providing output grays by adding the compensation grays to the input grays; and providing data voltages corresponding to the output grays to pixels, wherein the calculating of the compensation grays includes:

referring to a lookup table which records compensation values corresponding to some of previous conversion grays and some of the conversion grays, where the conversion grays correspond to a current pixel row, and the previous conversion grays correspond to two previous pixel rows; and calculating first interpolated values by interpolating the compensation values for some of the pixels.

13. The driving method of the display device of claim 12, further comprising calculating second interpolated values by interpolating the first interpolated values for others of the pixels.

14. The driving method of the display device of claim 13, further comprising providing the second interpolated values as the compensation grays.

15. The driving method of the display device of claim 13, further comprising scaling the second interpolated values according to a maximum luminance gain which increases as a maximum luminance increases; and converting the scaled second interpolated values into values in a gray domain to provide the values in the gray domain as the compensation grays.

* * * * *